United States Patent [19]

Le Magourou

[11] Patent Number: 4,516,819

[45] Date of Patent: May 14, 1985

[54] MAKE AND BREAK ELECTRICAL CONNECTOR

[75] Inventor: Yves Le Magourou, Ermont, France

[73] Assignee: Societe d'Exploitation des Procedes Marechal, Paris, France

[21] Appl. No.: 519,868

[22] Filed: Aug. 3, 1983

[30] Foreign Application Priority Data

Aug. 9, 1982 [FR] France ..... 82 13891

[51] Int. Cl.[3] ..... H01R 13/635

[52] U.S. Cl. ..... 339/46; 339/111

[58] Field of Search ..... 200/51.09; 339/46, 75 R, 339/75 M, 111

[56] References Cited

U.S. PATENT DOCUMENTS

| | | | |
|---|---|---|---|
| 1,754,585 | 4/1930 | Valkenburg | 200/70 |
| 3,370,141 | 2/1968 | Garamszegi | 200/51.09 |

FOREIGN PATENT DOCUMENTS

| | | | |
|---|---|---|---|
| 0053194 | 6/1982 | European Pat. Off. . | |
| 1242735 | 4/1965 | Fed. Rep. of Germany . | |
| 2008420 | 9/1971 | Fed. Rep. of Germany | 339/111 |
| 2030264 | 12/1971 | Fed. Rep. of Germany | 339/111 |
| 1157309 | 5/1958 | France . | |
| 356812 | 10/1961 | Switzerland . | |
| 13455 | of 1913 | United Kingdom . | |
| 497810 | 12/1938 | United Kingdom . | |

*Primary Examiner*—John McQuade

*Attorney, Agent, or Firm*—Sandler & Greenblum

[57] ABSTRACT

A pressure contact is capable of providing an electrical connection between a plug connector-pin and a stationary current-supply contact means placed within the internal chamber of a plug socket. A movable conductive member placed within the socket is adapted to be thrust rearwardly by the connector-pin in opposition to a first torsional spring located along a path which is parallel to the axis of the contact. The conductive member then moves clear of guide lugs and tilts forward abruptly, under the action of a second torsional spring, until a contact bead attached to the end of the movable member is applied against the stationary contact bead in order to form an electrical connection.

12 Claims, 7 Drawing Figures

MAKE AND BREAK ELECTRICAL CONNECTOR

BACKGROUND OF THE INVENTION

1. Field of the Invention

The present invention generally relates to an electric pressure contact or connector and is more specifically directed to an electrical pressure contact having built-in opening and closing capability, i.e., a make-or-break connector or switch.

Contacts of this type can be employed in a variety of devices, e.g., modular systems, separable single-pull switches, and so on, but is particularly adaptable for use in equipping industrial current-supply connectors.

Industrial connectors must conform to regulations defined by Publication 309-I of the International Electrotechnical Commission (I.E.C.), and particularly that portion thereof which establishes the minimum breaking capacity for each size of connector.

2. Discussion of the Prior Art

In sliding contact connectors (contacts comprising connector-pins and sockets), the contact pressure exerted is perpendicular to the movement of withdrawal of the connector-pin and acts in opposition to such movement, resulting in a breaking capacity which is virtually non-existent. In order to comply with the Commission's regulations as noted hereinabove, therefore, connectors of this type need to be locked by a switch.

In pressure-contact connectors, the contact pressure is exerted in a direction parallel to the movement of separation and assists the movement, thus requiring the provision of locking means for maintaining the desired contact pressure. It is then only necessary to add a suitable device to the locking means to ensure that the contact elements separate at a predetermined distance and speed at the moment of unlocking. In this fashion, the characteristics defined in Publication 309-I of the I.E.C. can thus be readily obtained. However, some countries, and most particularly the United States, require industrial current-supply connectors to have a contact breaking capacity which is comparable to that of a switch or, in other words, that they can achieve the performance specified for switches by Publication 408 of the I.E.C. In end-pressure contacts of the type presently in use, current-supply connectors cannot satisfy this requirement because, at the moment of unlocking and before the contact elements separate, the contact pressure, which is on the order of a few kilograms, decreases and eventually falls to zero at the moment of separation, the speed of separation additionally being limited by the inertia of the system.

Two types of pressure contacts are presently utilized:

(a) for currents which are below 250 amps, pressure contacts are provided which include a resilient contact having a movable head mounted on a spring, the resilient contact being electrically connected to a stationary stud in order to connect the conductors via a braided wire element which is co-axial with the spring; and (b) for currents which are above 250 amps, pressure contacts are used which include a rocker-arm operating at right angles to a line of contact elements.

The present invention provides a third type of pressure contact and is capable of endowing the two above-noted pressure contacts with the breaking capacity of a switch by utilizing a rocker-arm which operates in a direction which is parallel to the line of contact elements.

In comparison with contacts which utilize a braided wire element, a system of the present type offers all of the advantages of a rocker-arm contact; specifically, these advantages include:

(a) the voltage drop of the device is guaranteed to be timely because, in contrast to braided wire element devices, variable voltage drops occur only at a contact point;

(b) the disadvantages inherent in brazing or crimping of braided wire elements are eliminated;

(c) the cross-section of the rocker-arm can be formed of a size which is at least equal to the largest conductor which it is possible to connect to the device; and (d) movement of the rocker-arm results in a powerful self-cleaning effect for the contacts of the system.

Further, in this design, each contact becomes a single-pulse switch having quick make and break-type action which is independent of the action produced by the switch operator.

SUMMARY OF THE INVENTION

In accordance with one aspect of the present invention, the pressure contact establishes an electrical connection between a conductive connector-pin, which is rigidly carried by the insulating support of a plug, and a stationary contact blade, which is electrically connected to an input terminal. The stationary contact is placed within a chamber formed in the insulating support of the plug socket when the plug connector-pin is introduced axially into the plug socket chamber. The bodies of the plug and of the socket are adapted to carry associated guiding and locking means for initiating and maintaining mating action of the elements. The pressure contact essentially comprises a rigid and movable conductive member which is placed within the plug socket chamber and which extends over a portion of the height of the chamber. This conductive member is designed to be thrust rearwardly toward the end wall of the chamber by the free end of the connector-pin, which is applied against the end heel of the movable member in opposition to the action of a first resilient means, which tends to apply the heel against the edge of a chamber bore. Guiding means are provided to ensure that the movable member will undergo a displacement in a direction which is substantially parallel to the longitudinal axis of the contact, until the end of the member, which is remote from the heel, reaches the level of the stationary contact bead, which is connected to the input terminal. The movable member and the guiding means are arranged so that, at the end of the substantially parallel displacement, the member moves away from the guiding means in order to tilt forwardly and to be abruptly applied against the stationary contact bead under the action of a second resilient means. The second resilient means assists in abruptly opening the contact at the time that the plug connector-pin is withdrawn by enhancing the tilting motion of the movable member.

A veritable make and break switch is thus obtained which simultaneously causes high contact pressure and compliance with safety regulations because the stationary tensioned contact bead cannot be touched accidentally. It is thus impossible to gain access to the contact bead simply by thrusting back the movable member.

The present invention, in a first aspect thereof, comprises a pressure contact adapted to establish an electrical connection between a movable conductive connector-pin rigidly attached to a plug support and a stationary contact bead electrically connected to an input terminal and located within a plug socket chamber, when said connector-pin is axially introduced into said plug socket chamber. The support and socket include means for guiding the contact pin into said chamber. The pressure chamber comprises:

(a) a rigid and movable conductive member located within said plug socket chamber, said conductive member adapted to be biased rearwardly towards an end wall of said chamber by continued axial movement of a free end of said connector-pin, said rigid conductive member including an end heel at one end thereof which is contacted by said connector-pin free end as it moves longitudinally through said chamber;

(b) first resilient means for biasing said heel against the edge of a bore within said chamber;

(c) means for guiding said movable member in a first direction which is substantially parallel to the axis of said member, until an end of said member which is located remote from said heel is substantially longitudinally aligned with said stationary contact bead; and (d) second resilient means for biasing the rigid conductive member away from said guiding means in order to tilt a movable bead contact located at said remote end of said rigid conductive member forwardly and into abutment with said stationary contact bead, said second resilient means further comprising means for assisting in the separation of said movable contact bead from said stationary contact bead when said plug connector-pin is withdrawn from said chamber.

The present invention is provided for in a second aspect thereof by a connector for placing a plug having a conductive pin and a socket having a chamber into electrical engagement. The connector comprises a movable connector member having a first, generally U-shaped end including a heel with a lower surface, a second generally T-shaped end having a contact bead with two sides and a lateral extension on each said side, and a third position connecting said first and second ends and which is narrower than said second end. The contact member has an inner surface on which the contact head is attached and an outer surface. A first spring is provided; it includes one arm positioned within the coil of a second spring and a second arm in abutting relationship with a projection extending inwardly from one of the walls of the chamber. The second spring has one arm in abutment with the outer surface, a coil positioned in the U-shaped end, and a second arm positioned within the chamber.

BRIEF DESCRIPTION OF THE DRAWINGS

Other features of the present invention will become more apparent to those of ordinary skill in the art to which this invention pertains upon further consideration of the following description and accompanying drawings, in which.

DETAILED DESCRIPTION OF THE DRAWINGS

Figure 1:
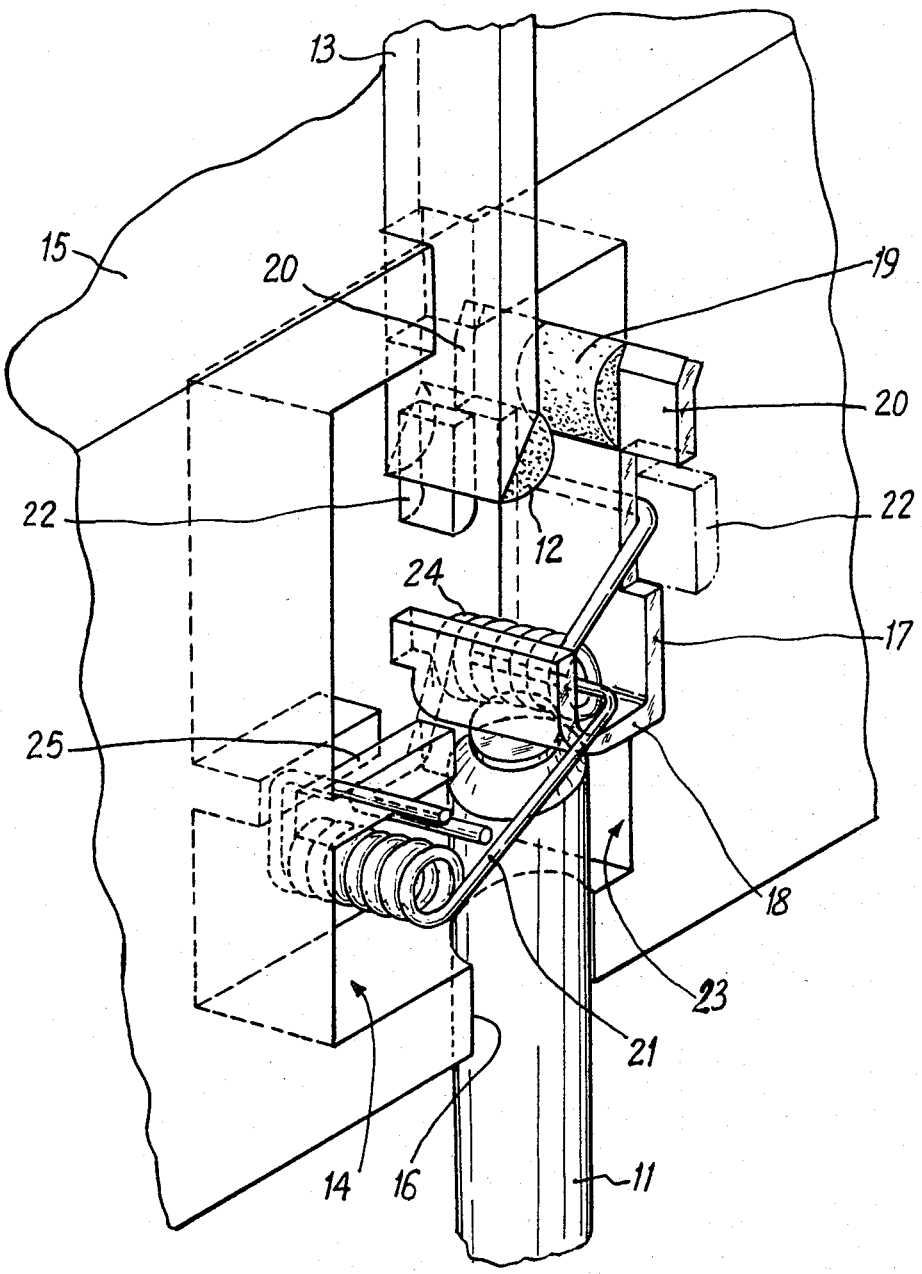
FIG. 1 is a partial sectional view of a contact formed in accordance with the present invention.

In the accompanying drawings, an end-pressure contact is illustrated which is designed to establish an electrical connection between a conductive connector-pin 11, which is rigidly attached to the insulating support of a plug (not shown), and a stationary contact bead 12, which is electrically connected to an input terminal (not shown) by conductive strip 13. The stationary contact bead 12 is placed within a chamber 14 formed within insulating support 15 of a plug socket (which is not otherwise illustrated; the chamber is provided with bore 16 to permit the axial introduction of connector-pin 11. The electrical connection between pin 11 and contact bead 12 is achieved by guided longitudinal displacement, which is followed by the tilting motion of rigid conductive member 17. This member is thus placed within chamber 14 and is adapted to extend along at least a portion of the height of chamber 14.

In the example illustrated in the drawings, movable conductive member 17 comprises a small plate, best shown in FIG. 1, one end of which is bent rearwardly twice at 90° in order to form a U-shaped heel 18. The other remote end of the small plate is adapted to carry a movable contact bead 19; the bead is designed to cooperate with stationary contact bead 12 and is provided with lateral extensions 20, to provide the member with a T-shaped configuration.

In its rest position (shown in FIG. 2A), i.e., before or after withdrawal of connector-pin 11, movable member 17 is urged toward the exterior of chamber 14, while heel 18 of the member is applied against one end or edge of bore 16 under the action of a first torsional coil spring 21. One end arm of the spring is engaged within the U-shaped portion formed by heel 18, while the other end arm is clamped and held in position against the internal wall of chamber 14.

Two guide lugs 22, which are spaced from chamber side wall 23, along which member 17 can be longitudinally displaced, are placed transversely within chamber 14 and are substantially aligned with each other along a plane which is substantially parallel to the side wall. The distance between the opposite edges of the two guide lugs 22 is greater than the width of the central, relatively narrow portion of member 17, but smaller than the width of the T-shaped remote end portion of member 17.

A second torsional coil spring 24 is intended to act on member 17. One end arm of the second spring is applied against that face of the member which is directed toward side wall 23 of the chamber and on the member surface opposite from contact bead 19, the coil spring being placed within the U-shaped portion formed by heel 18. One advantageous feature is that one end arm of spring 21, which is engaged within the U-shaped portion of heel 18, is placed inside the coil of spring 24 and thus serves to maintain the spring in its position.

Figure 2A:
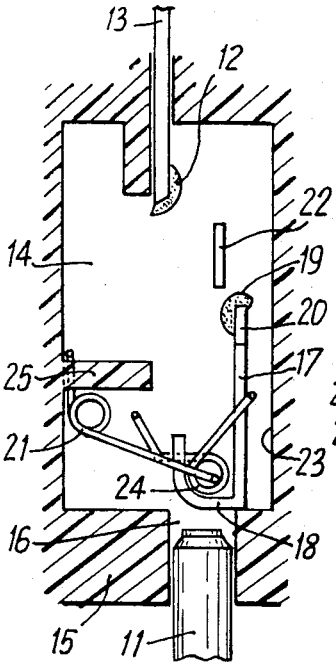
FIGS. 2A–2F represent diagrammatic views, taken along a smaller scale, which illustrate the different stages of operation of the movable member, e.g., at the times of inward displacement and outward withdrawal of the connector-pin.

In its rest position (as best illustrated in FIG. 2A), the T-shaped end of member 17, with its contact bead 19, is located at a lower level than the guide lugs 22 (assuming that the axis of the contact itself is vertical, as shown in the drawing), and the second end arm of spring 24 is not subject to any stress, i.e., it is freely positioned within chamber 14.

Figure 2B:
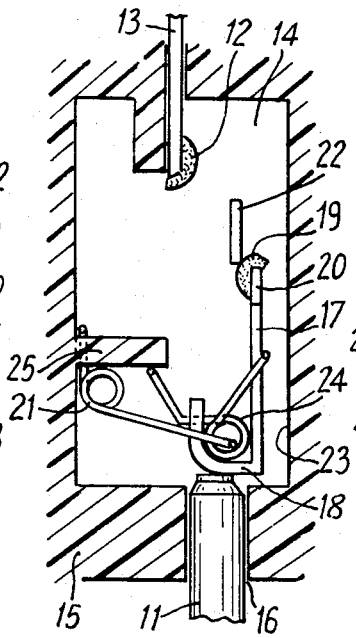

When connector-pin 11 is displaced axially inwardly of bore 16 and of chamber 14, the free end of the pin is applied against heel 18 of member 17. When the inward displacement continues, member 17 is thrust rearwardly in the direction of the end wall (unreferenced) of the chamber. In a first stage of movement (best illustrated in FIG. 2B), the lateral extensions 20 of member 17 are engaged between side wall 23 and guide lugs 22. Simultaneously, the free end of spring 24 abuts against at least one internal projection 25 of chamber 14; projection 25 also serves to maintain spring 21 in its position.

As the inward displacement of connector-pin 11 continues, member 17 undergoes a displacement in a direction which is substantially parallel to itself and towards the end wall of the chamber. In this case, the lateral extensions 20 are firmly applied against guide lugs 22 under the biasing action of spring 24 (as best shown in FIG. 2C).

Figure 2C:
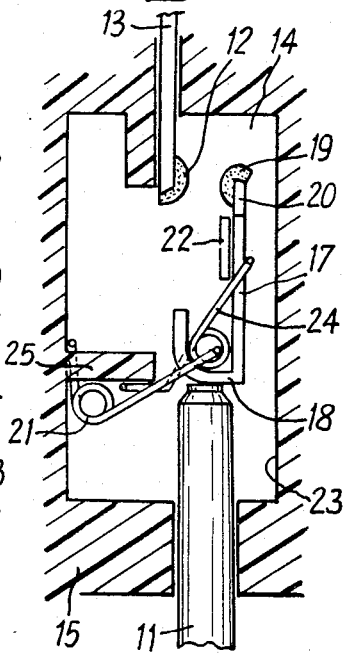
Figure 2D:
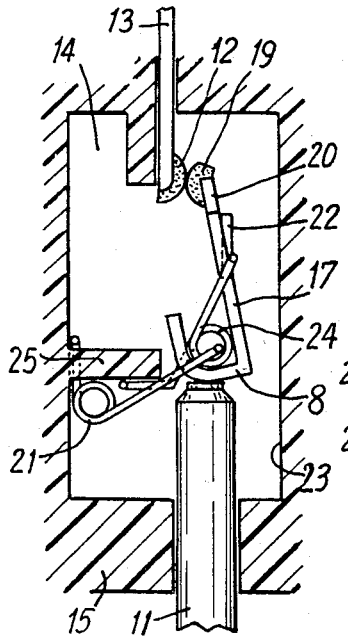

The assembly is arranged so that contact bead 19 of movable member 17 reaches the level of stationary contact bead 12 at the time that lateral extensions 20 pass beyond the top edges of guide lugs 22 (as shown in FIG. 1 and in FIG. 2C). Under the action of spring 24, member 17, which is no longer retained by lugs 22, then tilts forwardly towards the chamber wall which is positioned opposite to side wall 23. At this point, contact bead 19 is abruptly applied in abutting relationship against the stationary contact bead 12 (as best shown in FIG. 2D), thus resulting in abrupt closing of the contact.

It is readily apparent that locking action must occur in order to maintain connector-pin 11 in a stationary contact position. This locking action can be obtained by any known means, e.g., a bayonet-type coupling such that the plug which is rigidly fixed to the connector-pin will be locked in position with respect to the plug socket in which chamber 14 is located.

Figure 2E:
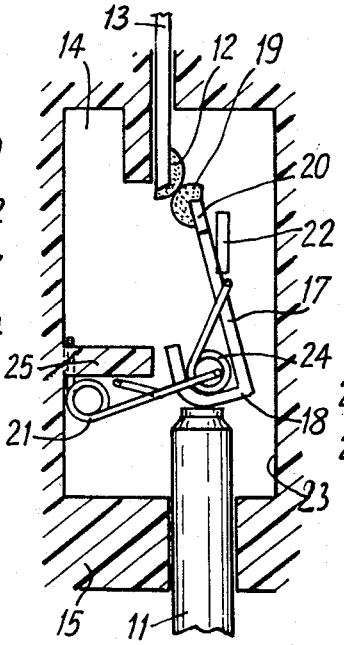

After unlocking, outward withdrawal of plug connector-pin 11 is achieved by simple axial traction. This movement is facilitated, enhanced, and accelerated by the action of spring 21, which tends to drive connector-pin 11 outwardly of the chamber by maintaining heel 18 applied against the top end of the connector-pin. At the beginning of the operation (as best illustrated in FIG. 2E), movable contact bead 19, which is still resiliently biased against stationary contact bead 12 by spring 24, slides over bead 12 in order to achieve self-cleaning of the contact bearing surfaces. As an additional advantageous feature, contact beads 12 and 19 are formed semicylindrically in order to produce a powerful self-cleaning action when they rub against one another.

Figure 2F:
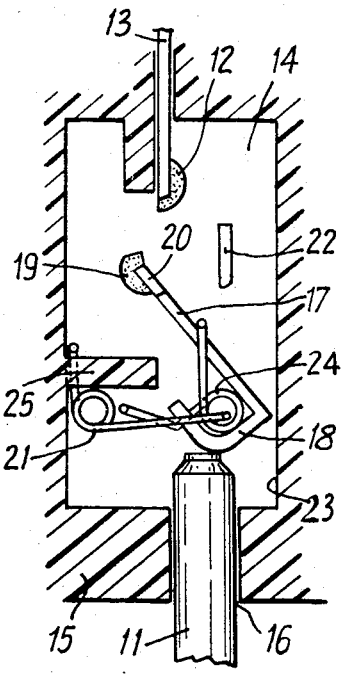

As the outward withdrawal of connector-pin 11 continues, member 17 continues to follow the pin in the direction of chamber bore 16. At a single moment, contact bead 19 moves away from contact bead 12 and, under the action of spring 24, tilts forwardly abruptly toward the wall which is oppositely located from side wall 23 (as seen in FIG. 2F), to thus abruptly open the contact. Simultaneously, the end arm of spring 24 moves away from projection 25; since spring 24 is thus freed from any further stress, member 17 is subjected only to the action of spring 21, which accordingly applies the curved front portion of heel 18 against the top end of connector-pin 11. The point of contact is not level with the end arm of spring 21, and member 17 thus tends to move back to its upright position, this movement being facilitated by the curved design of heel 18. At the end of its travel path, the heel of member 17 is applied against the edge of the chamber bore, thus reassuming its rest position (as best shown in FIG. 2A) to prepare itself to again receive the inserted connector-pin 11. It is possible, however, to devise different means for guiding member 17 as it returns to its upright position.

Thus, the contact is a true single-pole switch of the quick mkee-and-break type.

The foregoing description relates to a single contact employed alone, but it is apparent and obvious that a plurality of contacts of this type permit the construction of different devices, particularly current supply connectors in which each contact (with the possible exception of an existing earth contact) will perform the function of a switch. This arrangement is achieved independently of all known arrangements which may be adopted (angular displacement of at least one contact, insulating supports having variable angular positions, single or double density safety disks, and so on).

Although the present invention has been described with respect to specific features, embodiments, and advantages thereof, it is clear that a variety of such embodiments, features, and advantages are contemplated as within the scope of the present invention.

What is claimed is:

1. A pressure contact adapted to establish an electrical connection between a movable conductive connector-pin rigidly attached to a support and a stationary contact bead electrically connected to an input terminal and located within a plug socket chamber, when said connector-pin is axially introduced into said plug socket chamber, said support and said socket including means for guiding said connector pin into said socket, said pressure contact comprising:

(a) a rigid and movable conductive member located within said plug socket chamber, said conductive member adapted to be biased towards an end wall of said chamber by continued axial movement of a free end of said connector-pin, said rigid conductive member including a heel at one end thereof which is contacted by said connector-pin free end as it moves longitudinally through said chamber;

(b) first resilient means for biasing said heel against the edge of a bore located within said chamber;

(c) means for guiding said movable member in a first direction which is substantially parallel to the axis of said member, until an end of said member which is located remote from said heel is substantially longitudinally aligned with said stationary contact bead; and (d) second resilient means for biasing the rigid conductive member away from said guiding means to tilt a movable contact bead at said remote end of said rigid conductive member forwardly and into abutment with said stationary contact bead, said second resilient means further comprising means for assisting in the separation of said movable contact bead from said stationary contact bead when said plug connector-pin is withdrawn from said chamber.

2. A pressure contact in accordance with claim 1 wherein said movable member comprises a small plate, one end of said plate including two approximately 90° folds and comprising said heel, said heel having a generally U-shape and being adapted to be contacted by a free end of said connector pin when said connector pin is inserted into said chamber.

3. A pressure contact in accordance with claim 2 wherein said small plate includes said remote end of said member and said movable contact bead attached thereto, said remote end further comprising a pair of lateral extensions, a respective one of said extensions positioned on each side of said bead so as to form a generally T-shaped configuration.

4. A pressure contact in accordance with claim 3 wherein said means for guiding said movable member comprise two substantially aligned lugs transversely located within said chamber along a plane which is substantially parallel to a side wall of the chamber along which said movable member is displaced, said guide lugs being spaced from said side wall, the distance between opposite edges of said lugs being greater than the width of a central portion of said movable member and smaller than the width of said T-shaped remote end of said member.

5. A pressure contact in accordance with claim 4 wherein said second resilient means comprise a torsional coil spring, said spring having a first end arm which is adapted to abut against a different surface of said movable member than the surface to which said movable contact bead is attached.

6. A pressure contact in accordance with claim 5 wherein said second resilient means includes a second end arm which is freely positioned prior to insertion of said connector-pin, and which is in abutment with a projection extending inwardly from at least one wall of said chamber when said connector-pin is inserted into said chamber and when said T-shaped end portion of said movable member thus engages rear faces of said guide lugs.

7. A pressure contact in accordance with claim 6 wherein said stationary contact bead and said movable contact bead are both semi-cylindrical, and thus comprise means for self-cleaning one another when said beads are rubbed against each other.

8. A pressure contact in accordance with claim 6 wherein said first resilient means comprises a coil spring having a first end which abuts against said inwardly extending projection and a second end which is positioned within the coils of said torsional coil spring.

9. A connector for placing a plug having a movable conductive connector pin and a socket having a chamber into electrical engagement, said connector comprising:

(a) a movable contact member having first, generally U-shaped end including a heel with a lower surface; a second, generally T-shaped end having a contact bead with two sides and a lateral extension on each said side; and an intermediate portion connecting said first and second ends and which is narrower than said second end, said contact member having an inner surface on which said contact bead is attached and an outer surface, said movable contact member being positioned within said socket chamber and being adapted to be biased towards an end wall of said chamber by axial movement of said conductive connector pin;

(b) a first spring having one arm positioned within a coil of a second spring and a second arm positioned in abutting relationship with a projection extending inwardly from one wall of said chamber;

(c) said second spring having one arm abutting said outer surface of said contact member, a coil positioned in said U-shaped end, and a second arm positioned within said chamber; and (d) means located within said socket chamber for guiding movement of said movable contact member as it is biased towards, said chamber end wall.

10. A connector in accordance with claim 9, wherein said chamber includes a bore into which said connector pin is inserted, the free end of said connector pin being adapted to contact said heel when said pin is inserted.

11. A connector in accordance with claim 9, wherein said guide means comprises a pair of guide lugs located in substantial alignment along a plane which is substantially parallel to one side wall of said chamber, said lugs being spaced apart from each other by a distance greater than the width of said intermediate portion and less than the combined width of said contact bead and said lateral extensions.

12. A connector in accordance with claim 9 wherein a conductive strip extends into said chamber at an end opposite from an end of said chamber into which said conductive pin is adapted to be inserted, said conductive strip having a stationary contact bead located at an end of said strip.

* * * * *